US007303192B2

(12) United States Patent
Marshall et al.

(10) Patent No.: US 7,303,192 B2
(45) Date of Patent: Dec. 4, 2007

(54) DROP TURN TARGET

(75) Inventors: Thomas Marshall, Lake Shore, UT (US); Kyle E. Burdette, Eagle Mountain, UT (US); Kyle E. Bateman, Provo, UT (US); Chris Butterfield, Payson, UT (US)

(73) Assignee: Action Target, Inc., Provo, UT (US)

( * ) Notice: Subject to any disclaimer, the term of this patent is extended or adjusted under 35 U.S.C. 154(b) by 39 days.

(21) Appl. No.: 11/397,948

(22) Filed: Apr. 3, 2006

(65) Prior Publication Data

US 2007/0024006 A1 Feb. 1, 2007

Related U.S. Application Data

(60) Provisional application No. 60/668,900, filed on Apr. 5, 2005.

(51) Int. Cl.
*F41J 1/10* (2006.01)

(52) U.S. Cl. ..... 273/406; 273/390

(58) Field of Classification Search ..... 273/359, 273/369, 370, 390–392, 406, 407
See application file for complete search history.

(56) References Cited

U.S. PATENT DOCUMENTS 631,175 A * 8/1899 Parnall ..... 273/406
2,208,010 A 7/1940 Whitmore
3,103,362 A * 9/1963 Elofson ..... 273/359
3,348,843 A * 10/1967 Stanley ..... 273/406
3,992,007 A * 11/1976 Seeman ..... 473/575
4,232,867 A * 11/1980 Tate, Sr. ..... 273/406
4,440,399 A * 4/1984 Smith ..... 273/348.4
4,540,182 A * 9/1985 Clement ..... 273/392
5,350,180 A * 9/1994 Acock ..... 273/406
6,325,376 B1 * 12/2001 Elliott et al. ..... 273/406
6,398,215 B1 * 6/2002 Carroll ..... 273/108
7,134,977 B2 * 11/2006 Campbell et al. ..... 473/454

OTHER PUBLICATIONS

Law Enforcement Targets, Inc. (LET), "Reactive Target Systems, Drop Turn Target System" (Advertisement) Oct. 12, 2004, 6 pages.*

* cited by examiner

*Primary Examiner*—Mark S Graham
(74) *Attorney, Agent, or Firm*—Bateman IP Law Group

(57) ABSTRACT

An improved drop/turn target is easier to construct and operate than existing drop/turn targets. The drop/turn target may be adjusted for wear, and may easily be configured to operate in a variety of different modes. The drop/turn target may also be raised or lowered during operation and may be automatically reset for subsequent use.

28 Claims, 6 Drawing Sheets

DROP TURN TARGET

RELATED APPLICATIONS

The present application claims the benefit of U.S. Provisional Application No. 60/668,900, filed Apr. 5, 2005.

BACKGROUND OF THE INVENTION

1. The Field of the Invention

The present invention relates to targets for use in target ranges and ballistic training. More specifically, the present invention relates to an improved drop/turn target for ballistic training.

2. State of the Art

A drop/turn target is one which, when released, falls relatively slowly through a predetermined distance and turns as it drops. Typically, the target will fall about one or two feet. The target is configured to rotate while falling so that the shooting surface on the target presents itself to the user at predetermined times. Thus, the user has a small window of time in which they may shoot at the target. At the same time, the target is moving, further increasing the challenge for the shooter.

While drop/turn targets are known, they suffer from some disadvantages which make the targets more difficult to machine and less durable once in operation. The target is typically made to turn by mounting the target on a vertical piece of steel which has been twisted at predetermined locations. The twisted piece of steel passes through a top plate and into a tube. Accordingly, the top plate holds the section of the twisted steel entering the tube in a defined orientation, thus causing the twisted steel to rotate and forcing the target to turn. It is difficult to machine the slot in the top plate so that the slot holds the steel strip adequately, but without binding, thereby adding expense to the target.

The functionality of the top plates is also limited as they can not be adjusted easily to account for wear. It is also difficult to change the orientation of the top plate should the user desire that the target rotate and present the target surface differently to the user.

Additionally, various mechanisms in the target, such as the release lever and pin, are exposed and may be hit by bullets during use, damaging the target and possibly preventing use of the target. The release pins may also be somewhat difficult to use, requiring precise placement to lock the target in the initial position.

There is thus a need for an improved drop/turn target which is easier and less expensive to manufacture. There is also a need for a target which is easier to use than targets known in the prior art. Additionally, there is a need for a target which is more easily adapted to different modes of operation. Finally, there is a need for a target which may be adjusted to ensure reliable operation, accounting for wear as the target is used.

SUMMARY OF THE INVENTION

It is an object of the present invention to provide an improved drop/turn target. It is a further object of the present invention to provide a drop/turn target which is easier to manufacture and which is simpler and more reliable to operate.

According to one aspect of the present invention, a drop/turn target may be made with a top plate which is easier to manufacture and which is easier to operate. A top plate may be made which is formed of two separate halves. Each half forms one side of the slot through which a twisted piece of strip steel passes. Accordingly the top plate may be easily adjusted to account for wear and to change the operation of the target.

According to another aspect of the present invention, a target release mechanism is provided which is easier to operate is provided.

According to yet another aspect of the present invention, a target which is pneumatically controlled is provided. The target may be formed with an air bleed valve which controls the rate of fall of the target. Additionally, the target may be formed with an air inlet port which allows a person using the target to raise the target remotely by introducing pressurized air into the target. The air pressure may be controlled to control the rate at which the target rises, allowing the target to be used while rising or falling.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The various embodiments shown accomplish various aspects and objects of the invention. It is appreciated that not all aspects of the invention may be shown in a single drawing, and thus multiple drawings are used to describe the various aspects and structures of the present invention.

DETAILED DESCRIPTION

The drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
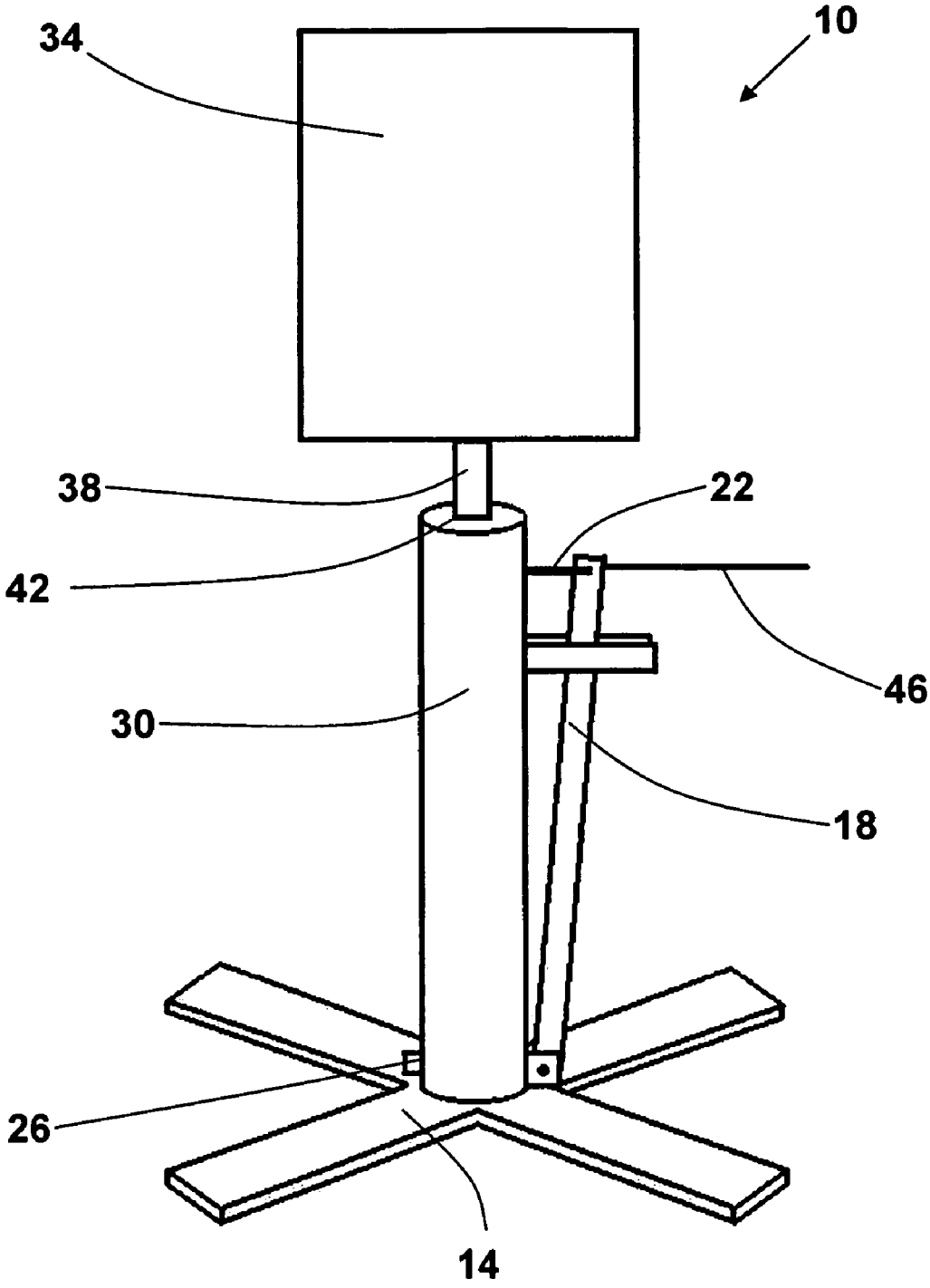
FIG. 1 (Prior Art)
FIG. 1 shows a perspective view of a drop/turn target as known in the prior art.

Turning to FIG. 1 a drop/turn target known in the prior art is shown. The target, indicated generally at 10, typically includes a stand 14, a lever 18 which is mounted to a release pin 22, an air bleed valve 26, a body 30, a target 34, a target shaft 38, a cap 42, and a plunger (not shown). The target shaft 38 is typically a flat strip of steel which has been twisted at predetermined locations along the shaft, such as near the top and/or bottom of the shaft. The cap 42 covers the end of the body 30 and is formed with a slot therein for receiving the target shaft 38. The cap 42 is typically bolted or welded to the body 30. Thus, as the target 34 and target shaft 38 falls, the interaction between the slot in the cap 42 and the twist in the shaft 38 causes the target 34 to rotate. Thus, the target may be made to alternate between presenting a target surface to the shooter and not presenting the target surface to the shooter by varying the twist in the portion of the shaft 38 which is passing through the cap 42.

The lower end of the shaft 38 is typically connected to a plunger (not shown) which forms at least a somewhat air tight seal with the inside bore of the body 30, which is typically cylindrical. The bottom of the body 30 may be provided with an adjustable air bleed valve 26 which controls the release of air from the body 30 as the target 34 and plunger fall. The target is locked in a raised position by the release pin 22, which is attached to a lever 18. The release pin fits in a hole in the target shaft 38. When desired, a user pulls a string 46 which in turn moves the lever 18 and pulls out the pin 22 to thereby release the target 34.

Figure 2A:
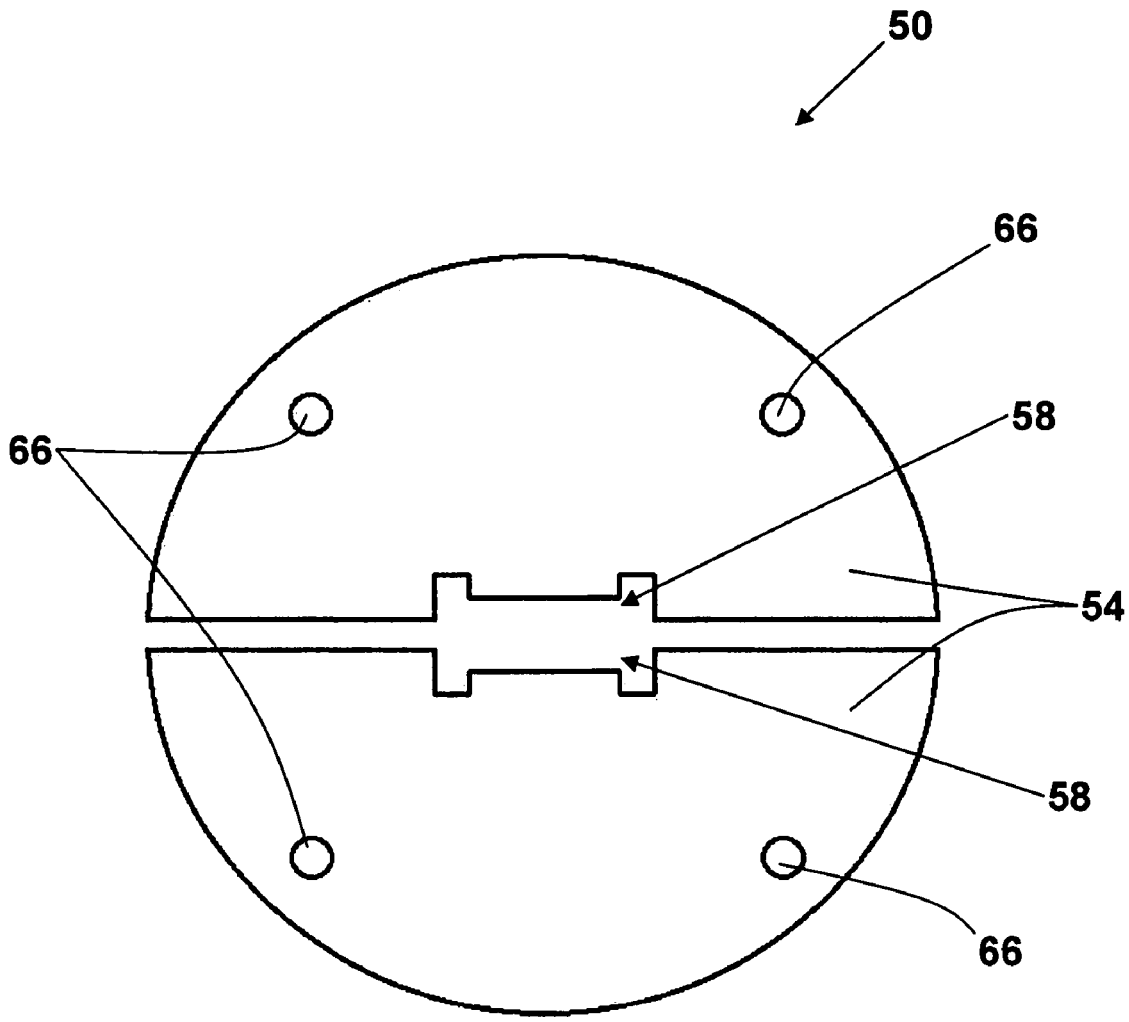
FIGS. 2*a* and 2*b* show top views of top plates of the drop/turn target according to the present invention.

Turning now to FIG. 2*a*, a top view of a top plate of the drop/turn target of the present invention is shown. The top plate 50 is formed from two halves 54. Each of the halves has a cutout portion 58 which form a guide for the target shaft (not shown). The cutout portions 58 are formed such that the resulting slot in the top plate is generally 'H' or 'I' or hourglass shaped. The use of such a shape helps prevent the target shaft from binding in the slot. Additionally, each of the halves has at least one, and preferably at least two, holes 66 for mounting the top plate to the target body (not shown).

Figure 2B:
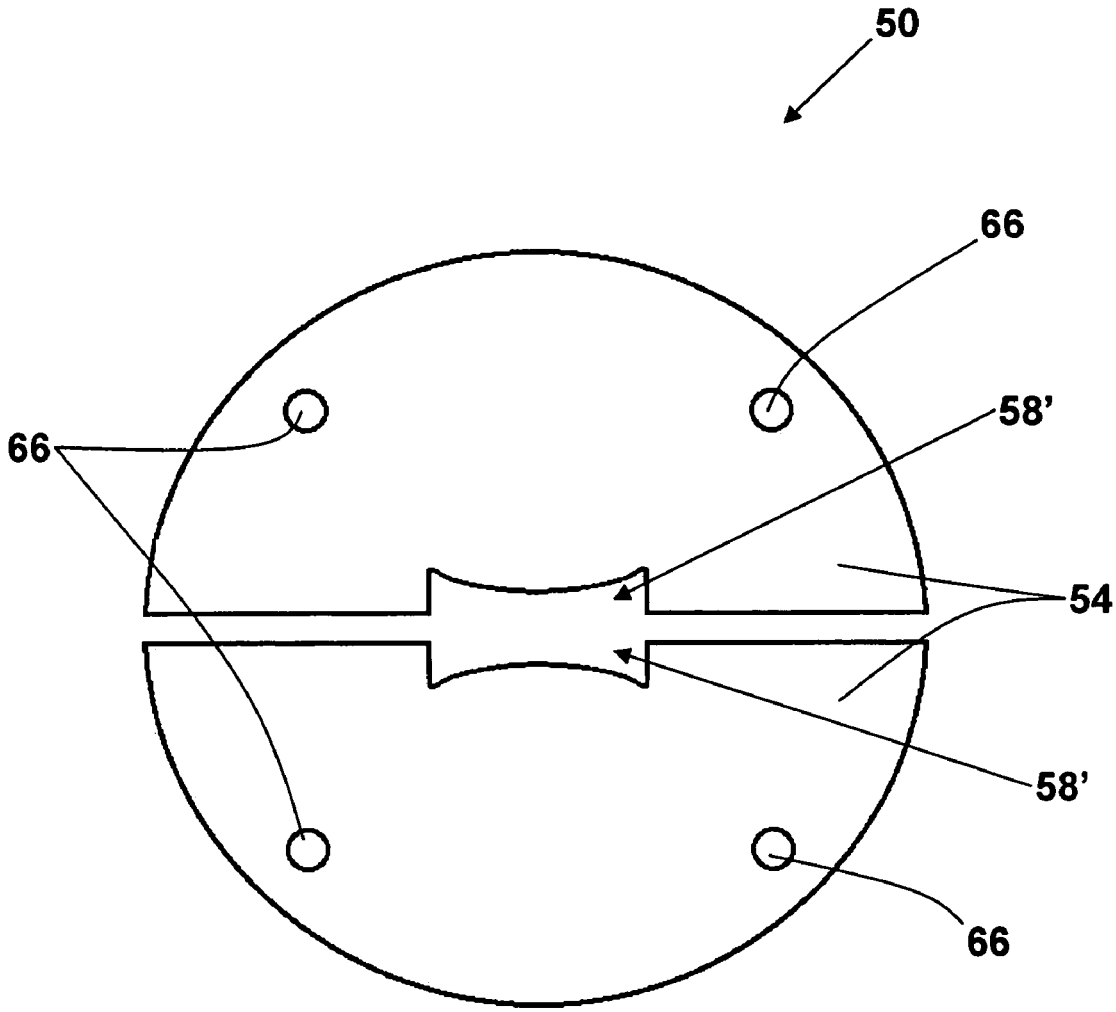

FIG. 2*b* shows a top view of an alternate top plate design of the drop/turn target of the present invention. The top plate 50 is formed of two halves 54 which are shown with an alternate central cutout portion 58' to receive a target shaft, and mounting holes 66 for mounting the top plate 50 to a target body. As discussed above, the cutout portions 58' are shaped so as to form a slot when the two top plate halves 54 are disposed adjacent each other. The cutout portions 58' are such that the ends of the slot are wider than the middle of the slot. Such a configuration allows the target shaft to slide through the slot with less binding of the twisted target shaft in the slot.

The top plate 50 according to the present invention is advantageous because it is easier to form than a conventional single piece top plate. Because of the twist which is formed in the target shaft, the openings 58, 58' are advantageously formed with ends that are wider than the middle of the opening, as is the case for the H/I shaped or hourglass shaped opening of FIG. 2*a* or the curved or crescent shaped opening of FIG. 2*b*. Such an opening with wider ends allows the target shaft to slide through the slot more easily. A target shaft might bind in a straight slot because of the twist in the target shaft. It is appreciated that the opening having wider ends than center is somewhat difficult to machine. For a single piece top plate, the opening is machined as a hole which is not open to an edge of the plate, eliminating many machining processes and making precise machining of the opening difficult. Additionally, a single piece top plate can not be adjusted to account for wear in the plate or target shaft, or imprecise machining of the top plate.

Conversely, a two piece top plate 50 according to the present invention may be more easily machined because the hole for the target shaft is open to the inside edge of each target half. Additionally, the distance between the two halves 54 of the top plate and the alignment between the halves may be adjusted as the plates are mounted on the target body if holes 66 are elongate slots or are simply larger than the bolts used to attach the plates, allowing the user to easily fine tune the operation of the target.

Additionally, the top plate 50 may easily be removed, rotated, and reattached to the target body to change the direction that the target surface faces. This allows the user to easily change the operation of the target (meaning whether a target surface is presented to the shooter) from a 'present, non-present, present' or 'present, non-present' operation to a 'non-present, present, non-present' or 'non-present, present' operation and vice-versa. Forming holes 66 such that a square geometry is created by the holes allows the top plate to be attached in any orthogonal orientation. It is appreciated that forming a different number of holes and using a different number of mounting bolts, such as 3 holes and bolts or 6 holes and bolts, would allow the target orientation to be changed by 120 degrees or by 60 degrees. Using 4 bolts and holes and rotating the target orientation in 90 degree increments is advantageous for common shooting ranges.

Thus, the two piece top plate 50 of the present invention makes the target more versatile and easier to setup and operate. It will be appreciated that if the holes in the top plate are formed in a square orientation centered around the target shaft opening, the top plate halves may be easily rotated by 90 degrees without requiring additional bolt holes. Additionally, making the holes somewhat oversized as compared to the bolt will allow the plate to be moved slightly to adjust operation of the target by simply loosening the bolts, sliding the top plate, and tightening the bolts.

Figure 3:
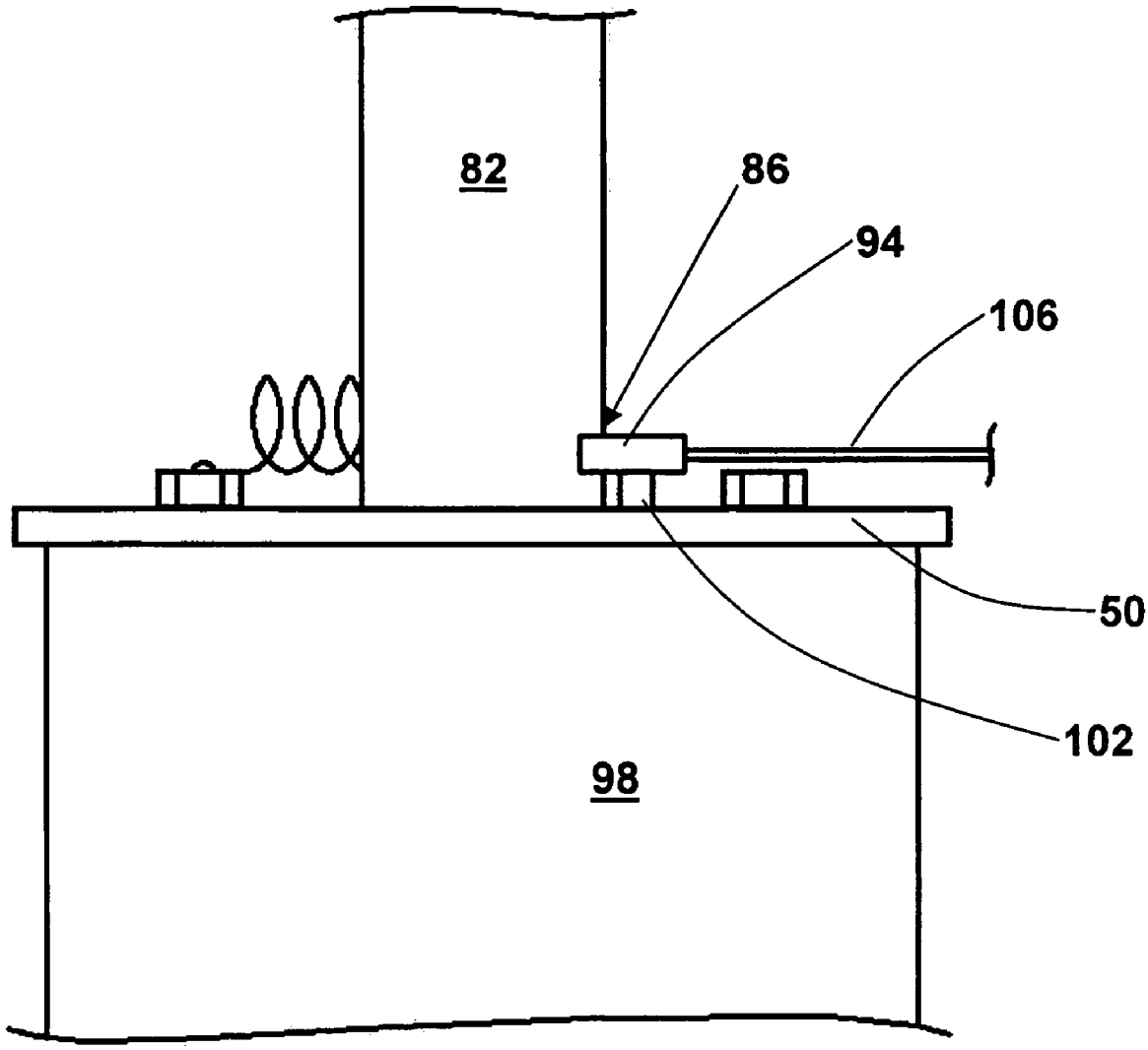
FIG. 3 shows a side view of a portion of the drop/turn target according to the present invention.

Turning now to FIG. 3, a side view of a portion of the drop/turn target of the present invention is shown. The side view highlights an improved catch mechanism according to the present invention. The target shaft 82 is typically formed from a strip of steel which is twisted as desired to selectively present the target to a shooter as the target moves vertically. The target shaft 82 is formed with a notch 86 near the bottom end of the shaft 82, such that when the shaft 82 and target (not shown) are raised, the notch 86 is above the top plate 50. A catch mechanism such as a lever 94 is attached to the top plate 50 or the target body 98. The lever 94 can pivot about an attachment point 102 such that the end of the lever 94 is pivoted between a first position wherein the lever 94 engages the notch 86 and a second position wherein the lever does not engage the notch 86. Alternatively, the catch mechanism 94 may be slidably mounted to engage the notch 86.

When the lever 94 engages the notch 86, the lever 94 prevents the shaft 82 and target from moving vertically. The lever 94 may accordingly be biased into the first position so as to engage the notch and thereby prevent the target from falling with the use of a spring or other suitable biasing element. Accordingly, when a user desires that the target fall, the user may simply pull on a cord or cable 106 which is attached to the lever 94 such that pulling on the cord 106 pivots the lever 94 into the second position and allows the target to fall. It will be appreciated that the present system is simpler and less prone to failure than the prior art release mechanisms, and also may be used to automatically engage the shaft 82 to thereby lock the position of the target if so desired. Thus, a user may simply pull up on the target to raise and lock the target, whereas the prior art configurations require the user to fit a locking pin through a hole in the body and secure the shaft.

Figure 4:
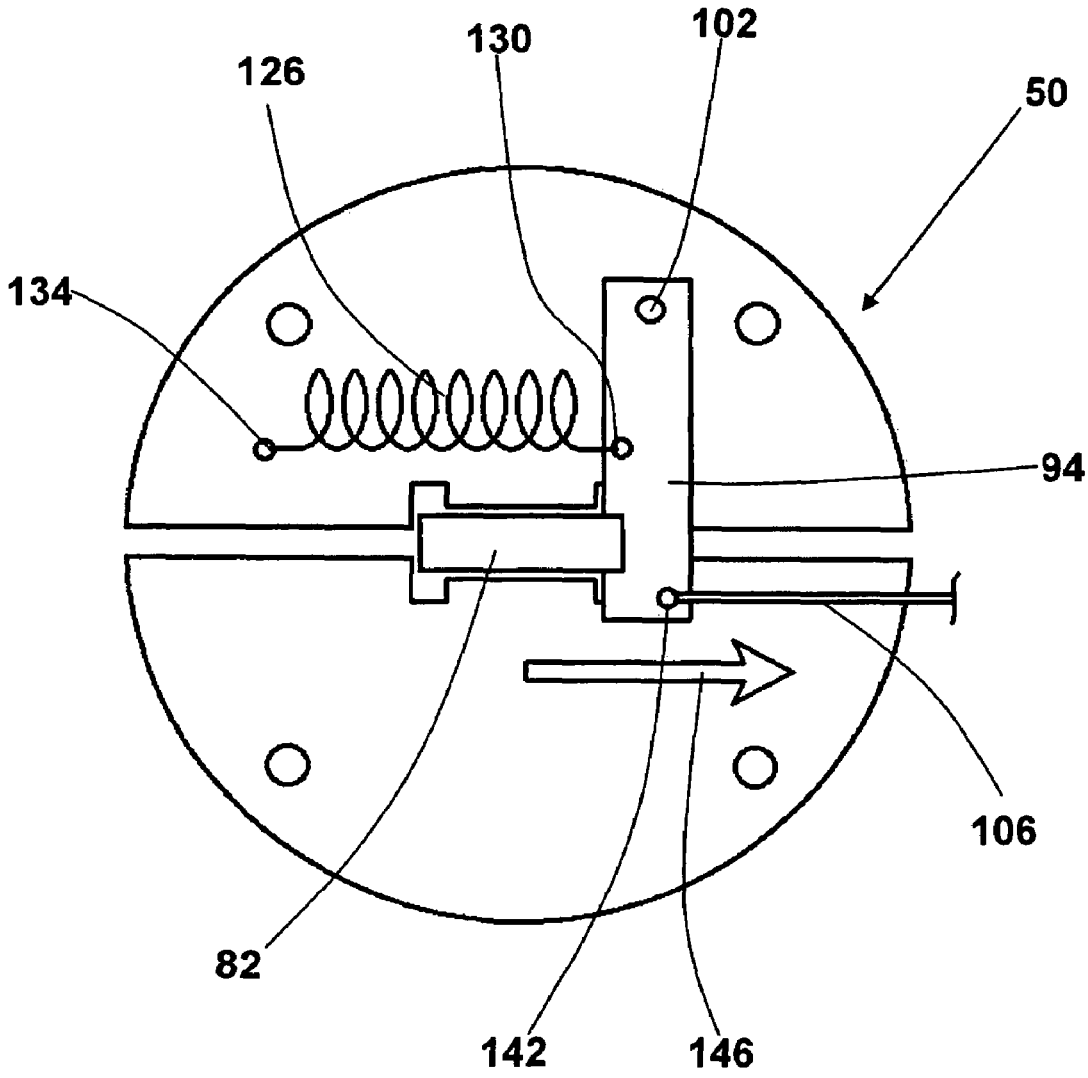
FIG. 4 shows a top view of a portion of the drop/turn target body according to the present invention including a top plate and release mechanism.

Turning now to FIG. 4, a top view of the locking mechanism of FIG. 3 is shown. The target shaft 82 and lever 94 may be seen in a locked position wherein the lever 94 is nested inside of a notch 86 formed in the shaft 82 to prevent movement of the shaft 82. The lever 94 has been pivotably attached to the top plate 50 at attachment point (pivot) 102. A biasing element 126, such as a spring, is attached to the lever 94 at hole 130 and to the top plate at mount 134. The biasing element 126 urges the lever 94 into the first locking position as shown, and may be used to thereby lock the shaft 82 automatically when the shaft 82 is raised. A cord 106 is attached to the lever at hole 142, and may be pulled to thereby pivot the lever 94 in the direction of arrow 146, moving the lever into a second unlocked position whereby the shaft 82 is released from the lever 94 and may move vertically.

Figure 5:
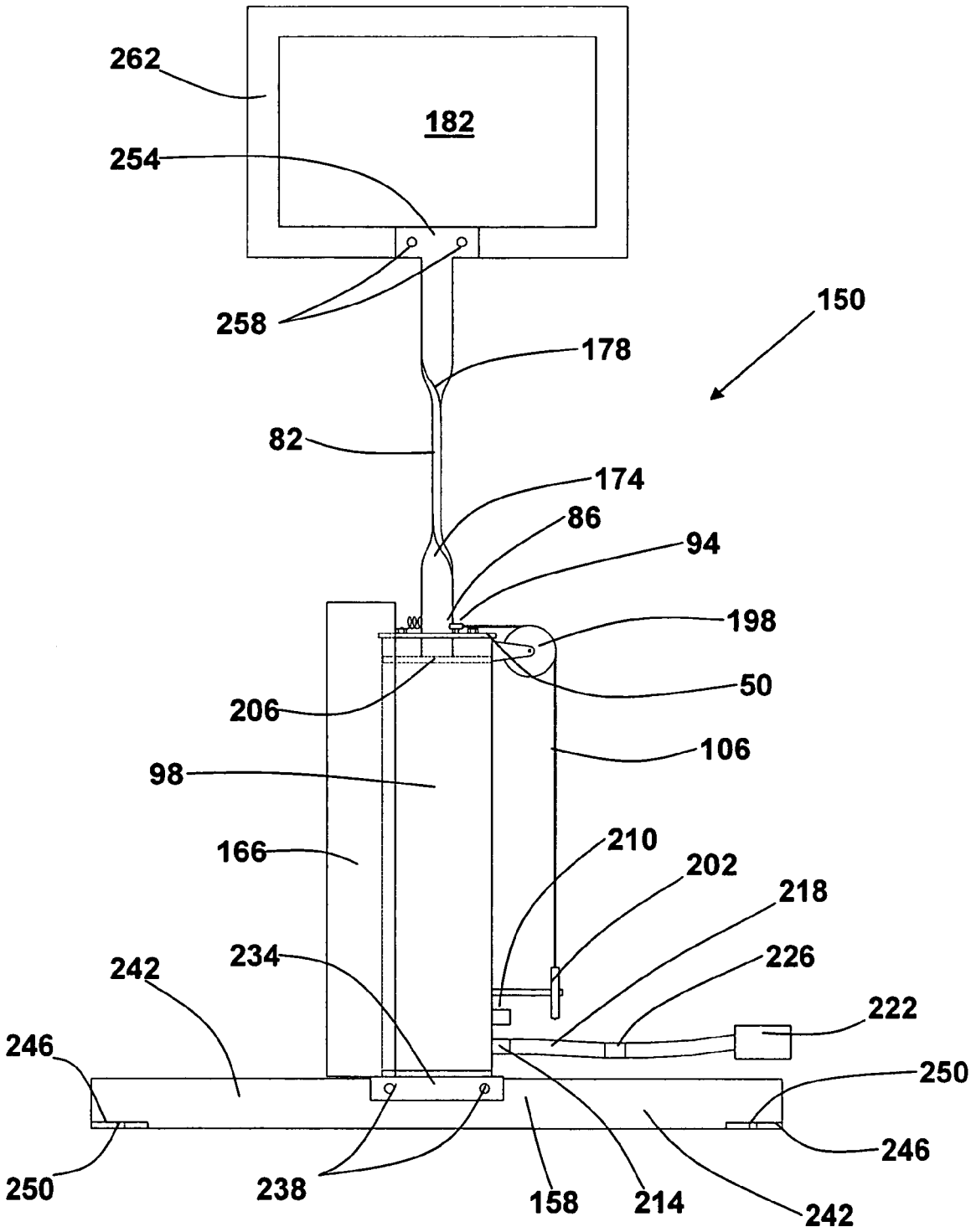
FIG. 5 shows a side view of the drop/turn target according to the present invention.

Turning now to FIG. 5, a side view of the drop turn target according to the present invention is shown. It is appreciated that the present invention may embody a complete target having the drop/turn assembly and a bullet target, or a target adapter having the drop/turn assembly and configured to receive a bullet target. The target adapter, indicated generally at 150, is formed with a body 98, a stand 158, a target shaft 82, and a bullet deflection plate 166. As described, the shaft 82 is twisted, and may be moved vertically such that the interaction between the twisted shaft 82 and the slot 86 formed in the top plate 50 causes the shaft to rotate. As shown, the shaft 82 has a first twist 174 and a second twist 178, causing the shaft to rotate twice while moving vertically. Accordingly, the bullet target 182 which is mounted to the shaft 82 may be rotated such that it is initially not presented to the shooter, is presented to the shooter for a period of time, and is then moved so as not to be presented to the shooter. By varying the number, size, and location of twists 174, 178, etc. in the shaft 82, the movement of the bullet target 182 may be varied.

As described in FIG. 3 and FIG. 4, the target adapter 150 is provided with a locking mechanism comprising a notch 86 formed in the shaft 82 and a lever 94 which engages the notch. Although not necessary, in a preferred embodiment, the lever 94 is biased to engage the notch 86, and will thus automatically engage the notch and lock the position of the bullet target 182 when the target shaft 82 and notch 86 are moved into a predetermined position. A cord or cable 106 is used to move the lever 94 to thereby allow the shaft 82 and bullet target 182 to move. As shown, the cord 106 may be routed across pulleys 198, 202 to direct the cord 106 as desired.

A plunger 206 is attached to the end of the shaft 82. The plunger 206 is sized and shaped so as to at least resist or impede the flow of air between the plunger and the body 98. Typically, the plunger 206 and body 98 are both round in cross section so that the plunger may rotate within the body 98 as the shaft 82 moves vertically through the top plate 50 and is thereby rotated. However, those skilled in the art will appreciate that other cross sections may be used with the shaft 82 being rotatably attached to the plunger 206. The air which is contained below the plunger 206 and inside of the body 98 resists falling of the target shaft 82 and bullet target 182, once the shaft is released from a raised position, slowing the movement of the bullet target 182. Additionally, an air bleed valve 210 may be used to allow air to escape from the body 98 as the bullet target 182 falls. In a more preferred embodiment, the air bleed valve 210 is adjustable to allow a user to vary the time required for the bullet target 182 to fall. Accordingly, the bottom of the body 98 should be sealed to prevent air from quickly exiting the body 98, as may be simply done by welding a plate 230 over the bottom of the body 98.

According to one aspect of the present invention, an air inlet port 214 may be provided, which may be connected to an air supply via an air hose 218. The air inlet port 214 may be used to raise the bullet target 182 by providing pressurized air into the body 98. The air pressure provided to the air inlet port 214 may be adjusted to control the speed at which the bullet target 182 is moved upwards. Thus, in operation, the bullet target 182 may be in a raised and locked position whereby the lever 94 engages the notch 86 in the shaft 82. A user may then pull on a release cord 106 (manually or via a control mechanism), causing the target to fall whereby the twists 174, 178 in the shaft 82 cause the bullet target 182 to be presented to a shooter for a predetermined period of time. According to another aspect of operation, the air bleed valve 210 may be adjusted to control the time required for the bullet target 182 to fall, and thus the time during which the bullet target 182 is presented to a shooter.

According to yet another aspect of operation, a target adapter 150 which has been released and operated as described above may be raised by inserting pressurized air into the body 98. A user may move a valve 222, either manually, electronically, or otherwise to allow air to flow through an air line 218, through air inlet port 214, and into the target body 98. The air will fill the body 98, pressing against the plunger 206 and causing the bullet target 182 to rise, again presenting to a shooter for a predetermined period of time. It will be appreciated that the lever 94 may be biased against the shaft 82 as shown previously or otherwise configured to automatically engage the notch 86 in the shaft 82 once properly aligned with the shaft 82. Thus the target may be configured such that when the bullet target 182 and shaft 82 have moved upwardly a sufficient distance the lever automatically engages the shaft 82, and thereby resets the target adapter 150 for further use. Thus, a shooter or target operator need not enter the firing range to reset the target adapter 150, promoting both the safety and efficiency of the target range. The speed at which the bullet target 182 is raised, and thus the time during which the bullet target 182 is presented to the user, may be varied by varying the air pressure of the air supply, or by using an air line restrictor or air pressure regulator 226.

The target body 98 is shown with a flange 234 having mounting holes 238 formed therein, and used to attach the target adapter 150 to a base 158, or to an existing target system as may be used in various shooting ranges. The base 158 is shown attached to the flange 234, but may be welded, bolted, or otherwise attached to the body 98, or not used if another mounting option is more appropriate. The base 158 is designed to stabilize the target adapter 150 for use, and thus has elongate legs 242, and may be provided with flanges 246 having holes 250 to allow a user to stake the base 158 into ground, or to otherwise bolt, attach, or stabilize the target adapter 150. If a base 158 is not appropriate, such as in a shooting range with an existing target system, the flange 234 may be used to bolt or otherwise attach the target 150 to a mounting rail or other appropriate part of a target system.

The deflection plate 166 is used to prevent bullets from striking and damaging the more easily breakable parts of the target, such as the lever 94 and associated catch mechanism, the air bleed valve 210, or the air filling port 214. The bullet deflection plate 166 used is a piece of angle iron which has been welded or otherwise attached to the body 98 so as to protect the target 150 without interfering with the operation of the target adapter 150. The shaft 82 may be formed with any number of different bullet target attachment means. Shown is a flange 254 having holes 258, which may be used to directly attach a bullet target 182, or may be used to attach a frame 262 which supports the bullet target 182. In operation, many of such targets may be operated simultaneously or sequentially by appropriately connecting the actuation cables, air lines, etc. as is desired.

There is thus disclosed an improved drop/turn target. It will be appreciated that numerous modifications may be made to the present invention without departing from the scope of the invention as set forth in the appended claims. The preceding examples are illustrative of the invention, and do not define the scope of the invention.

What is claimed is:

1. A target adapter comprising:

a body having a first upper end and a second lower end;

a top plate disposed on the first upper end having a slot formed therein, wherein the top plate comprises two pieces;

a twisted shaft disposed in the slot so as to slide in and out of the body and thereby rotate while sliding, and having a first end disposed in the body and a second end disposed outside of the body;

a plunger disposed on the first end of the shaft and configured for resisting the flow of air between the body and the plunger;

a bullet target mount disposed on the second end of the twisted shaft; and a catch mechanism configured for selectively allowing and preventing movement of the twisted shaft relative to the body.

2. The target adapter of claim 1, wherein the catch mechanism comprises a notch formed in the twisted shaft and a lever attached to the body or the top plate and configured for selectively engaging the notch to thereby prevent movement of the shaft.

3. The target adapter of claim 2, wherein the lever is biased to engage the notch.

4. The target adapter of claim 1, wherein the twisted shaft is allowed to fall to move the target, and wherein the escape of air from the body controls the rate of fall.

5. The target adapter of claim 4, further comprising an air bleed valve for releasing air from the body.

6. The target adapter of claim 5, wherein the air bleed valve is adjustable.

7. The target adapter of claim 1, further comprising an air inlet port configured for injecting air into the body to thereby raise the twisted shaft.

8. The target adapter of claim 7, further comprising an air regulator to control the rate at which the twisted shaft is raised.

9. The target adapter of claim 7, further comprising an air restrictor to control the rate at which the twisted shaft is raised.

10. The target adapter of claim 7, further comprising a valve configured to allow an operator to raise the twisted shaft remotely.

11. The target adapter of claim 1, further comprising a flange on the second lower end of the body and configured for attachment to a stand.

12. The target of claim 1, further comprising a bullet target mounted to the bullet target mount.

13. A target adapter comprising:

a generally vertical body;

a top plate disposed on the top of the body, the top plate having a slot formed therein, the slot having a width which is adjustable;

a shaft slidably disposed in the slot so as to be extendable from or retractable into the body, the shaft having at least one twist formed thereon such that the shaft is pivoted as it slides within the slot; and means for attaching a bullet target to the top of the shaft such that the bullet target is moved with the shaft.

14. The target adapter of claim 13, wherein the top plate comprises two halves and wherein each half comprises a cutout portion along an edge thereof such that the two cutout portions form the slot.

15. The target adapter of claim 13, wherein the shaft has a notch formed therein and further comprising a catch mechanism which selectively engages the notch to thereby inhibit movement of the shaft.

16. The target adapter of claim 15, wherein the catch mechanism is mounted to the top plate.

17. The target adapter of claim 15, wherein the notch is formed in a lower portion of the shaft to lock the shaft in an extended position.

18. The target adapter of claim 15, wherein the lever is biased against the shaft and thereby biased into a locking position.

19. The target adapter of claim 13, further comprising an air inlet port configured for allowing the entry of air into the body to thereby extend the shaft.

20. The target adapter of claim 19, further comprising a valve disposed in pneumatic communication with the air inlet port and configure for allowing an operator to remotely extend the shaft.

21. The target adapter of claim 19, further comprising at least one of the group consisting of an air flow regulator and an air flow restrictor for controlling the speed at which the shaft is extended.

22. A method for operating a target comprising:

selecting a target adapter configured for allowing a bullet target to fall through a predetermined distance and for causing the bullet target to rotate while falling, wherein the target adapter has a top plate formed from two halves which engage the twisted shaft and thereby control rotation of the target as it moves through the predetermined distance;

mounting a bullet target to the target adapter; and causing the target to fall through the predetermined distance.

23. The method of claim 22, wherein the method further comprises injecting pressurized air into the target adapter to thereby raise the target through the predetermined distance.

24. The method of claim 23, wherein the method further comprises causing the target to rotate as it is raised through the predetermined distance.

25. The method of claim 22, wherein the method further comprises selecting a target adapter having a twisted shaft which supports the target, and wherein the twists in the twisted shaft cause the target to rotate as it moves through the predetermined distance.

26. The method of claim 22, wherein the method further comprises adjusting the halves of the top plate to achieve a desired gap between the top plate halves and the twisted shaft.

27. The method of claim 22, wherein the method further comprises selecting a target adapter comprising a locking mechanism for inhibiting movement of the bullet target, and wherein the locking mechanism is biased into a locking position.

28. A target adapter comprising:

a body having a first upper end and a second lower end;

a top plate disposed on the first upper end, the top plate being formed by a plurality of pieces configured for disposition adjacent one another to define an adjustable slot; and a twisted shaft disposed in the slot so as to slide in and out of the body and thereby rotate while sliding, and having a first end disposed in the body and a second end disposed outside of the body.

* * * * *

UNITED STATES PATENT AND TRADEMARK OFFICE

CERTIFICATE OF CORRECTION

PATENT NO. : 7,303,192 B2
APPLICATION NO. : 11/397948
DATED : December 4, 2007
INVENTOR(S) : Thomas Marshall et al.

It is certified that error appears in the above-identified patent and that said Letters Patent is hereby corrected as shown below:

Column 2:
Line 2, it reads "Accordingly the top plate may be easily"; should read --Accordingly, the top plate may be easily--
Line 6, it reads "target release mechanism is provided which is easier to"; should read --target release mechanism which is easier to--

Column 5:
Line 55, it reads "...welding a plate 230 over the bottom"; should read --...welding a plate over the bottom--

Signed and Sealed this

Tenth Day of February, 2009

JOHN DOLL
*Acting Director of the United States Patent and Trademark Office*